US005350343A

United States Patent [19]

DaSilva

[11] Patent Number: 5,350,343

[45] Date of Patent: Sep. 27, 1994

[54] MULTI-FUNCTIONAL HAND GRIPPING DEVICE

[76] Inventor: Elias S. DaSilva, 77-12 35 Avenue, Apartment B-34, Jackson Heights, N.Y. 11372

[21] Appl. No.: 143,309

[22] Filed: Oct. 27, 1993

[51] Int. Cl.[5] ..... A63B 21/00

[52] U.S. Cl. ..... 482/106; 482/93; 482/105; 482/139; 2/20; 294/25

[58] Field of Search ..... 482/93, 105, 106, 108, 482/139; 2/159, 161 R, 161 A, 16, 20; 273/165, 166; 294/25, 26

[56] References Cited

U.S. PATENT DOCUMENTS

| | | | |
|---|---|---|---|
| 1,583,606 | 5/1926 | Boussel | 294/25 |
| 2,205,957 | 6/1940 | Kinkis | 2/20 |
| 2,235,313 | 3/1941 | Cleveland | 2/20 X |
| 3,178,724 | 4/1965 | Perschke | 294/25 X |
| 3,381,304 | 5/1968 | Coco | 294/25 X |
| 3,411,159 | 11/1968 | Berkhemer | 273/165 X |
| 3,541,990 | 11/1970 | Du Mas | 294/25 X |
| 3,896,498 | 7/1975 | Pang | 294/25 X |
| 4,247,097 | 1/1981 | Schwartz | 482/105 |
| 4,247,101 | 1/1981 | Gallmeyer | 482/105 X |
| 4,487,412 | 12/1984 | Meeko | 482/106 X |
| 4,617,684 | 10/1986 | Green et al. | 2/20 |
| 4,754,499 | 7/1988 | Pirie | 294/25 X |
| 4,807,876 | 2/1989 | Lothar | 482/106 X |
| 4,827,535 | 5/1989 | Socey | 482/106 X |
| 5,004,231 | 4/1991 | Alread | 482/105 X |
| 5,081,715 | 1/1992 | Mascia | 2/20 |
| 5,261,299 | 11/1993 | Kondos | 2/20 X |

FOREIGN PATENT DOCUMENTS

| | | | |
|---|---|---|---|
| 1270602 | 6/1990 | Canada | 482/106 |
| 116670 | 8/1984 | European Pat. Off. | 482/105 |

*Primary Examiner*—Robert Bahr

*Attorney, Agent, or Firm*—David M. Klein

[57] ABSTRACT

A multi-functional hand-gripping device is disclosed. The device has a gripping pad which includes a hand pad and a wrist pad. The hand pad is sized and shaped to align with the hand surface of the user and to improve the grip on a weight bar when a bar is grasped. The hand pad is also adapted to be curved away from the hand surface of the user and wrapped around an object to be grasped. A securing strap secures the gripping device to the wrist. The securing strap preferably uses hook and loop securing means. A support strap centrally disposed in the hand pad provides extra support for lifting heavy objects. The gripping pad is preferably constructed of neoprene, and has a non-slip surface on one side and a second non-grip surface on the other.

8 Claims, 2 Drawing Sheets

MULTI-FUNCTIONAL HAND GRIPPING DEVICE

FIELD OF THE INVENTION

The present invention relates to hand gripping devices, and more particularly, to a multi-functional hand gripping device for providing improved grip and support for weight lifting.

BACKGROUND OF THE INVENTION

Gripping and support devices for use during weight lifting are well known in the art. The most common device for providing grip is the conventional workout glove. These usually incorporate a non-slip surface which helps the weight lifter to grip the weight bar while lifting.

When lifting very heavy weights to exercise the trapezius and back with the hands facing downward, the hand muscles will tire more quickly than the muscles being exercised since the hand muscles are not as strong. This poses a risk to the exerciser of dropping the weights, or may cause the exerciser to prematurely cease exercising. Power straps or lifting straps have been found to reduce this problem. Power straps are devices which wrap around the wrist and include a strap which is wrapped around the weight bar. Thus, when lifting, some of the weight being lifted is transferred from the wrists and hands to the forearms, which are more capable of supporting the load. Power straps may or may not employ a non-slip surface toward the weight bar, depending upon whether it is desired to allow the bar to be able to move within the grip.

SUMMARY OF THE INVENTION

The present invention is a multi-functional hand gripping device having a gripping pad which includes a hand pad and a wrist pad. The hand pad is sized and shaped to align with the hand surface of the user and to improve the grip on a weight bar when a bar is grasped. The hand pad is also adapted to be curved away from the hand surface of the user and wrapped around an object to be grasped so as to work like a power strap or grip support.

The wrist pad wraps at least partway around the wrist of the user for protecting the wrist and for transferring the load on the grip to the wrist and forearms.

A securing strap is provided which is attached to the wrist pad, and secures the gripping device to the wrist. The securing strap preferably uses hook and loop securing means. A support strap is fixedly attached to one side of the hand pad, and passes through a slot in the hand pad to the other side of the hand pad for providing extra support, especially when the device is used as a power strap or grip support. The gripping pad is preferably constructed of neoprene, and has a non-slip surface on one side and a second non-grip surface on the other.

DETAILED DESCRIPTION OF THE INVENTION

Figure 1:
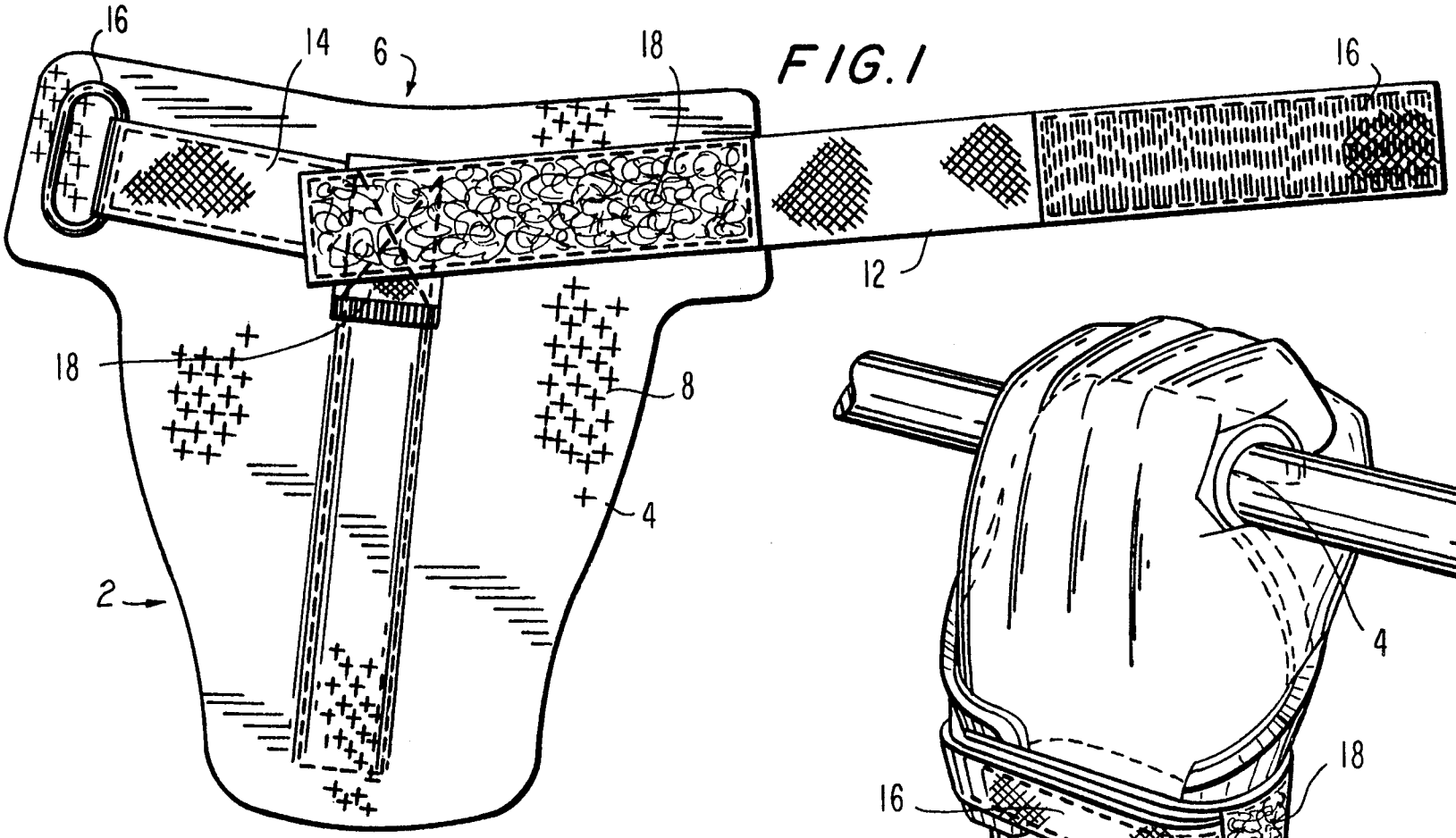
FIG. 1 is a top view of the hand gripping device of the present invention.
Figure 2:
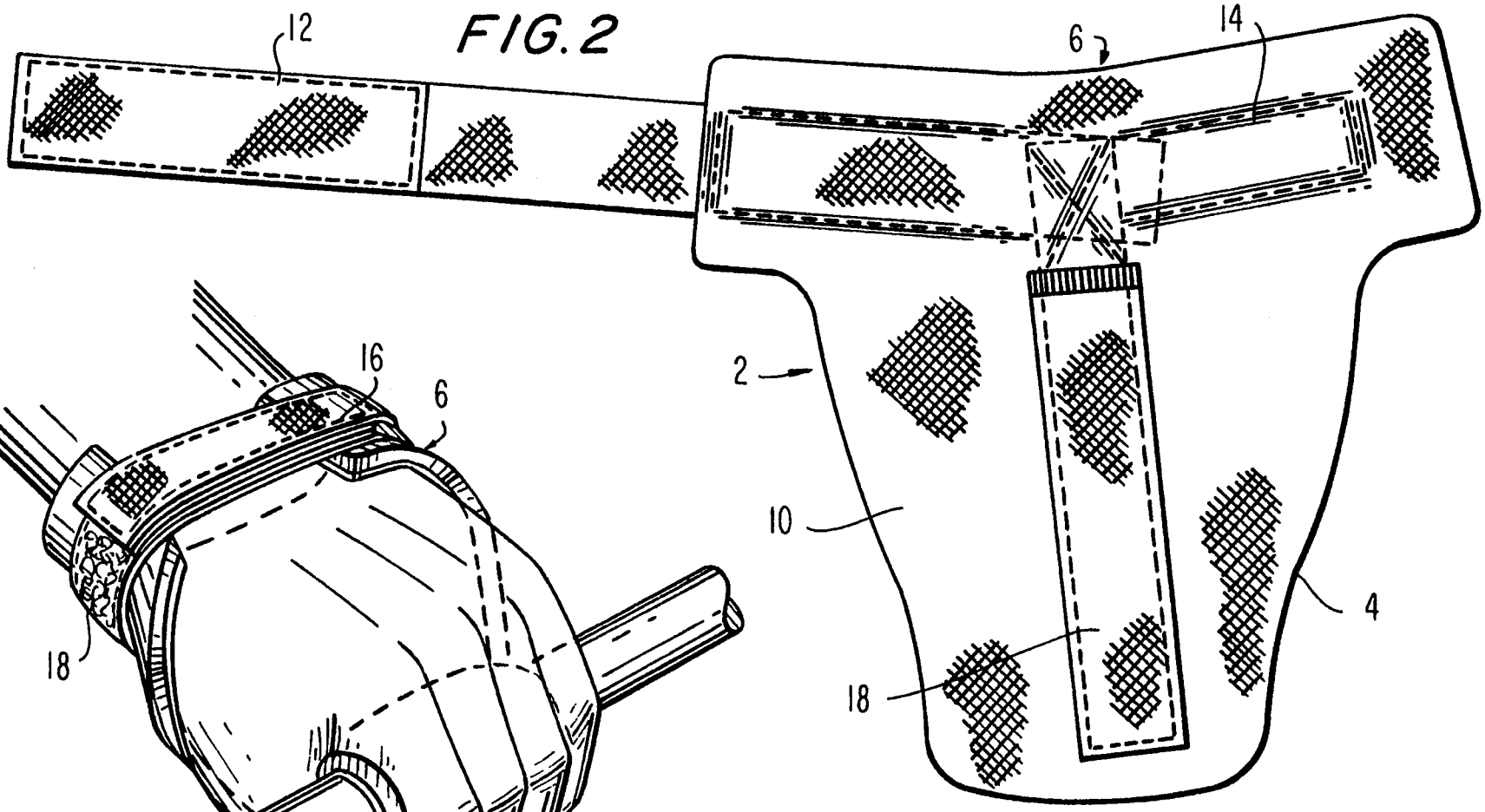
FIG. 2 is a bottom view of the hand gripping device of the present invention.

The present invention is a multi-functional hand gripping device especially suited for gripping and supporting a weight bar during weight lifting. As shown in FIGS. 1 and 2, the multi-function gripping device includes a gripping pad 2 for gripping and/or supporting a weight bar. Gripping pad 2 preferably has a palm or hand pad 4 integral with a wrist protection pad 6. The palm pad is sized and shaped to align with the hand surface of the user and to form a barrier between the hand surface of the user and an object to be grasped, the hand pad being further adapted to be curved away from the hand surface of the user, around an object to be grasped, and to form a barrier between the hand surface of the user and the object. The gripping pad 2 has a non-slip surface 8, which is coated with a textured rubber. This provides a non-slip grip and protects against callouses and blisters. The other surface of gripping pad 2 is preferably a non-grip surface 10 which is coated with a nylon or other non-grip material. In a preferred embodiment, gripping pad 2 is preferably constructed of neoprene, which is a nylon coated rubber. If neoprene is used, non-slip surface 8 is the rubber surface of the neoprene, and non-grip surface 10 is the nylon surface of the neoprene. The preferred neoprene for use in the present invention is TEXSKIN TM, sold by RUBATEX, INC. Other material may be substituted for those described with no change in the functionality of the device. If desired, both sides of the device may also be covered with either non-grip or non-slip materials, for use in weight lifting or other fields. For example, the gripping device with both sides covered with non-slip material might be useful for turning plumbing pipes.

As shown in FIGS. 1 and 2, the palm pad 4 is tapered from the wrist pad 6 toward the finger covering area of the palm pad 4. This is preferred in order to better protect the hand of the user, which is wider toward the wrist. The palm pad may be tapered differently, or not tapered at all, provided that the palm pad provides the multi-functionality described in detail below, and protects the hand of the user. The wrist pad 6 wraps at least partway around the wrist of the user and is securely attached to palm pad 4 or is preferably integral with palm pad 4. The wrist pad is intended to protect the wrist of the user.

A securing means, preferably attached to the wrist pad 6, is required in order to secure the gripping pad 2 to the wrist of the user, with the wrist pad 6 protecting the wrist of the user and the palm pad 4 aligned with the hand surface of the user. The securing means includes a first strap 12, a wrist strap, and a second strap 14, a securing strap. First strap 12 is preferably made of 1 inch nylon webbing and has hook material 16 disposed toward one end, and loop material 18, such as VELCRO TM, disposed toward the other end for securing the wrist strap around the wrist of the user. The locations of the hook and loop material may be reversed. The hook and loop material are preferably stitched to the wrist strap, but may otherwise be attached by any suitable technique. A portion of first strap 12 is fixedly attached to the gripping pad 2 toward one end, preferably by means of stitching. First strap 12 extends beyond gripping pad 2 a sufficient length to extend around the wrist of the user for securing the wrist strap in the manner described herein.

Second strap 14 preferably includes a metal ring 16 at one end, and is fixedly secured to the gripping pad 2 by means of stitching over its length. Second strap 14 is preferably made of 1 inch nylon webbing. A conventional buckle and belt strap or other strap may replace the wrist strap described, if desired.

As shown in FIGS. 1 and 2, a center support strap 18 is preferably centrally disposed along the gripping pad 2, parallel to the orientation of the user's hand in the pad. Support strap 18 is preferably made of 1 inch nylon webbing and is fixedly attached to the pad 2 by means of stitching or other suitable securing means. Over the length of the palm pad 4, support strap 18 is preferably surface mounted on the non-grip side 10 of the palm pad 4. A slit in the gripping pad 2 enables the support strap 18 to pass through the gripping pad 2 near the base of the user's wrist to the non-slip side 8 of the gripping pad 2. On the non-slip side 8, the support strap 18 is securely sewed to the gripping pad 2. The support strap 18 is also secured to first strap 12 and second strap 14 by means of stitching. Prior to attaching support strap 18 and second strap 14 to the gripping pad 2, support strap 18 is preferably looped once around the second strap 14. The ends of each are then securely sewed to the pad 2. This has been found to improve the durability of the gripping pad. Also, first strap 12 and second strap 14 preferably form a shallow V-shape where they are attached to pad 2. This has also been found to improve the performance and comfort of the gripping device. The support strap may also be "sandwiched" between layers of material so that it is not exposed and need not pass through the pad. The support strap might also be eliminated, although this is not preferred for weight lifting applications.

In order to attach the gripping device to a hand, the hand is placed face-down on the non-grip side 10 of the pad, with the wrist adjacent to the wrist protection pad 5, and the hand covering the palm pad 4. First strap 12 is then brought up and around over the wrist and looped through ring 16. First strap 12 is then brought back over the wrist until the hook and loop materials are aligned and the strap is snug. The hook and loop materials are then engaged.

Figure 3:
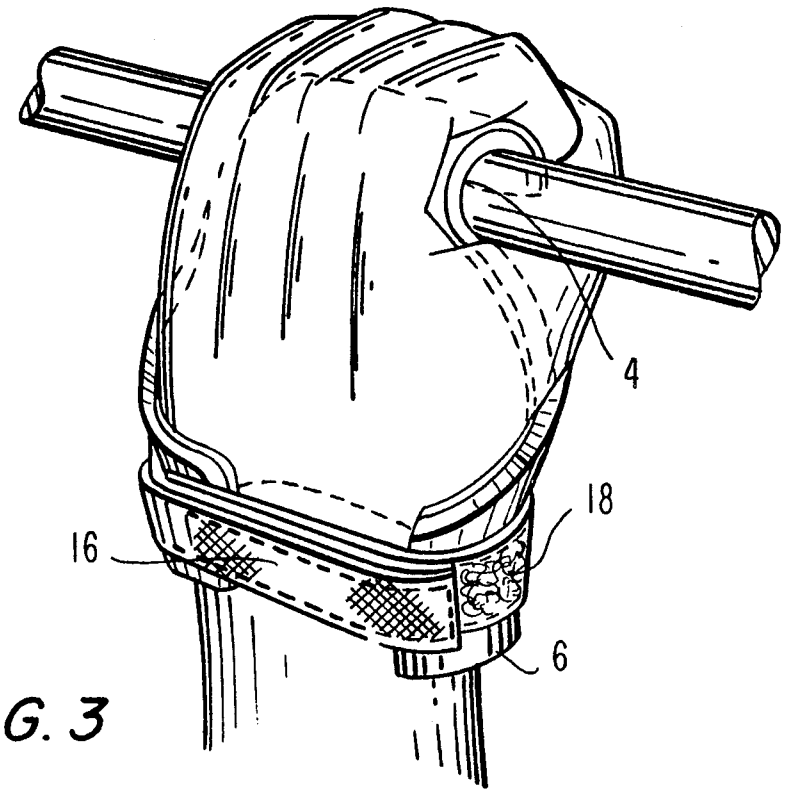
FIG. 3 is a perspective view of the hand gripping device being used to support a weight lifting bar.
Figure 4:
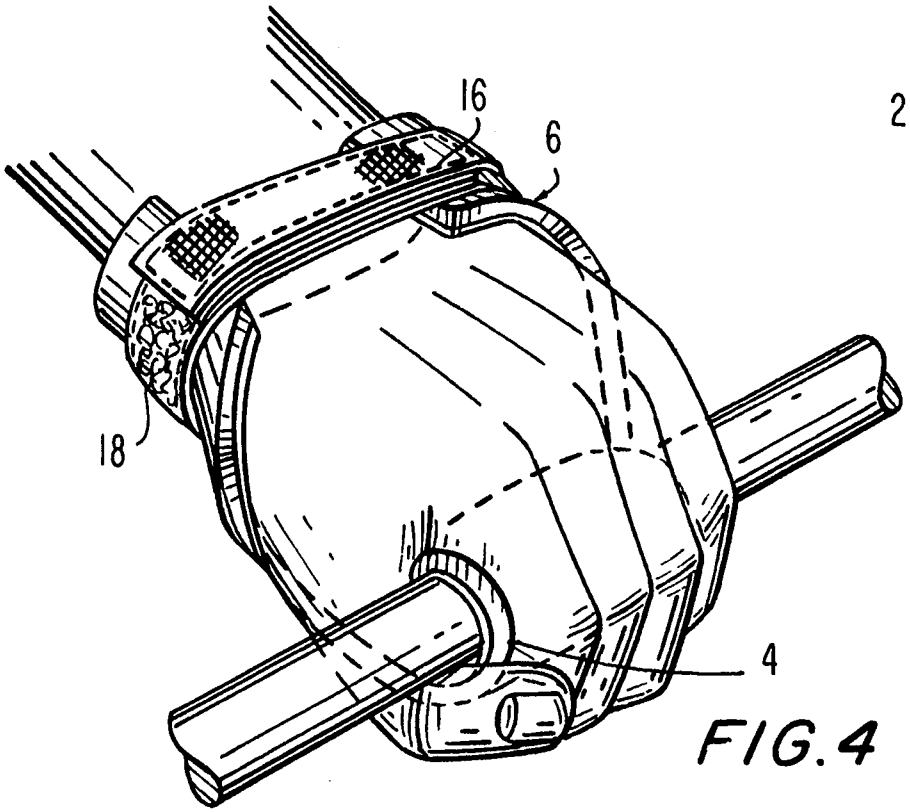
FIG. 4 is a perspective view of an alternative method of using the hand gripping device to support a weight lifting bar.

As shown in FIGS. 3 and 4, the present gripping device is multi-functional, and is especially suited for weight lifting applications. As shown in FIG. 3, the device may be used to improve the grip on a weight lifting bar. The pad 2 is wrapped around the bar with the non-slip surface 8 toward the bar. As the user grips the bar, the non-slip surface 8 greatly improves the user's grip on the bar. This is especially useful when lifting heavy weights.

As shown in FIG. 4, the gripping pad 2 may be used as a power strap or grip support. The pad is wrapped around the weight bar with the non-grip surface 10 disposed toward the bar, thereby allowing the bar to be movable within the pad. The non-slip surface 8 of the pad 2 is preferably held against the hand by the grip of the hand. Thus, a portion of the load being lifted is transferred to the pad 2. Since the nylon center support strap 18 is less resilient than the neoprene, the load will be transferred up the center support strap 18 to the wrist straps 12 and 14. This reduces the load on the user's hand and transfers this load to the user's wrist and forearm. It is to be understood that a grip pad 2 is preferably worn on each hand for use with barbells.

Although the present invention has been described with respect to certain embodiments, it is foreseen that other applications exist which are within the scope of the present invention as defined in the following claims:

What is claimed is as follows:

1. A multi-functional, hand gripping device which comprises:

(I) a flexible gripping pad which comprises:

(a) a wrist pad for wrapping at least partway around the wrist of a user for protecting the wrist, the wrist pad covering at least the portion of the wrist adjacent to the palm of the hand of the user; and (b) a hand pad comprising:

(i) a first end having a width, the first end being proximal to the wrist of the user and securely attached to the wrist pad over its entire width;

(ii) a free end; and, (iii) a substantially continuous non-grip surface disposed toward the hand of the user extending between the first end and the free end, and a substantially continuous non-slip surface opposite the non-slip surface extending between the first end and the free end, the hand pad being sufficiently wide to substantially cover the hand surface of the user to form a barrier between the hand surface of the user and an object to be grasped, the hand pad being further adapted to be curved away from the hand surface of the user at the free end, around an object to be grasped, and to form a barrier between the hand surface of the user and the object, the width of the hand pad being tapered from the first end to the wrist end whereby the surface of the hand pad is sized to substantially cover only the hand surface of the user; and (II) means for securing the gripping pad to the wrist of the user with the wrist pad protecting the wrist of the user and the hand pad substantially covering the hand surface of the user, the securing means being attached to the wrist pad.

2. The device according to claim 1 wherein the securing means comprises a wrist strap having hook and loop securing means.

3. The device according to claim 2 wherein the securing means further comprises a securing strap securely attached to the wrist pad at one end of the securing strap and having a ring attached to the other end, and wherein the hook securing means is disposed toward one end of the wrist strap and the loop securing means is disposed toward the other end of the wrist strap, the wrist strap being secured to the wrist pad at one end of the wrist strap and sized to enable the wrist strap to be wrapped around the wrist of the user, through the ring, and back around over the wrist of the user for aligning the hook and loop securing means for securing the securing means to the wrist of the user.

4. The device according to claim 3 further comprising a support strap centrally disposed along the hand pad in the direction between the first end and the free end, the support strap being fixedly attached to the hand pad.

5. The device according to claim 4 wherein the support strap is fixedly attached to one side of the hand pad, and passes through a slot in the hand pad toward the wrist pad to the other side of the hand pad, the support strap extending onto the wrist pad and being fixedly attached thereto.

6. The device according to claim 5 wherein the wrist strap and the second strap form a V-shape and are attached to the support strap.

7. The device according to claim 5 wherein the support strap is fixedly attached to the non-grip surface on the hand pad, and passes through the slot to the non-slip surface toward the wrist pad.

8. The device according to claim 1 wherein the gripping pad is constructed of neoprene, and the hand pad is integral with the wrist pad.

* * * * *